United States Patent [19]

Negro et al.

[11] 4,141,099

[45] Feb. 27, 1979

[54] PADS

[75] Inventors: Guido Negro, Neuffen; Frider Mann, Nüertingen; Hermann Buck, Hüelben, all of Fed. Rep. of Germany

[73] Assignee: Bielomatik Leuze & Company, Fed. Rep. of Germany

[21] Appl. No.: 794,208

[22] Filed: May 5, 1977

[30] Foreign Application Priority Data

May 11, 1976 [DE] Fed. Rep. of Germany ..... 2620688

[51] Int. Cl.[2] ..... B42B 5/12; B42C 19/08

[52] U.S. Cl. ..... 11/1 A; 281/25 A

[58] Field of Search ..... 11/1 A, 1 R; 281/25 R, 281/25 A

[56] References Cited

U.S. PATENT DOCUMENTS

| | | | |
|---|---|---|---|
| 2,097,888 | 11/1937 | Leyerle | 11/1 A |
| 2,117,242 | 5/1938 | Eramo | 11/1 A |
| 2,200,877 | 5/1940 | Farkas | 11/1 A |
| 2,299,061 | 10/1942 | Spinner | 281/25 A |

FOREIGN PATENT DOCUMENTS

| | | | |
|---|---|---|---|
| 2241757 | 3/1974 | Fed. Rep. of Germany | 11/1 A |

*Primary Examiner*—Donald R. Schran

*Attorney, Agent, or Firm*—J. Rodman Steele, Jr.

[57] ABSTRACT

A pad is made by inserting a comb through a row of holes along the spine of the pad, which has been assembled with a relatively stiff backing leaf overlying a cover leaf and curving the comb teeth over to form a closure joint between the ends of the teeth and the back of the comb. The binding apparatus includes a turn-over device for turning over the stiff backing leaf so that the latter now underlies the pad with the closure joint lying between the penultimate (or last normal) leaf of the pad and the now underlying backing leaf.

6 Claims, 9 Drawing Figures

PADS

Figure 1:
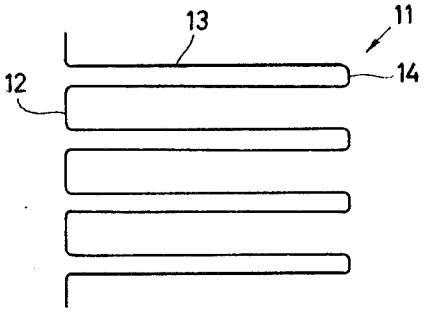

The invention relates to apparatus for and a method of binding pads having a relatively stiff last or backing sheet, such as exercise-books and calenders, and to pads having a comb binding in which the comb, after it has been inserted into a row of holes along the spine of the pad, is bent together to form a closure joint along the spine.

Comb bindings of this type are described in, for example, U.S. Pat. Nos. 3,334,918 and 3,555,587. The comb is bent from wire and has teeth formed by bending the wire which is bent back and forth to form portions spaced at short distances apart, while a somewhat longer portion of wire extends along the "back" of the comb transversely of the direction of the teeth. The teeth of this comb are bent together to form a circle such that the tips of the teeth are located in the interstices in the back. The teeth engage through the holes in the spine of the pad. The abutting ends of the teeth and the back portions of the comb form the closure joint. Bindings of this type have the advantage that even relatively thick pads can be bound by means of a comb curved to a cylinder whose diameter is only slightly greater than the thickness of the pad. Of course, the closure joint located on the spine of the finished pad has an unsightly appearance and also has the disadvantage that it is troublesome when turning the pages of the pad and, for example, when opening the first page, the entire spiral has to be turned in the holes such that the closure joint is located at the rear.

A feature of the invention is to provide a device which produces the pad in a form in which the closure joint is neither unsightly nor troublesome when using the pad.

Accordingly the invention provides apparatus for use in the binding of pads having a relatively stiff last or backing leaf and having a comb binding in which the comb, after it has been inserted into a row of holes along the spine of the pad is curved over to form a closure joint along the spine with the stiff last leaf initially overlying the first leaf of the pad, said apparatus comprising a turn-over device which is adapted to place the stiff last leaf located on the first leaf of the pad, onto the rear of the pad so that the closure joint of the comb binding lies between the stiff last leaf of the pad and the penultimate leaf thereof.

The invention includes a method of binding pads in which the pad is assembled with a relatively stiff backing leaf overlying the first leaf and a comb is inserted into a row of holes along the spine of the pad and curved over to form a closure joint, and in which the relatively stiff backing leaf is then folded back so as to underlie the penultimate leaf of the pad with the closure joint of the curved-over comb lying between the backing and penultimate leaves.

Thus, the pad, which normally has a thicker backing leaf, is manufactured with this leaf initially overying the first leaf of the pad (which may also be a slightly stiffer cover leaf in most cases). The comb is then inserted and the closure joint is produced. The backing leaf is now turned over by the turn-over means such that it assumes its intended position as the last leaf. The closure joint is now located between the last normal leaf of the pad (acutally the penultimate leaf) and the (last) backing leaf. The joint is no longer visible at this location and also does not impair the turning of the pages.

In the case of a comb type of binding, it is possible that a leaf might slip through between the tips of the teeth and the back of the comb at the closure joint in the case of high stress or when the comb is not completely closed. Of course, this risk only involves the leaf which is located nearest to the tips of the teeth and only when the sheet is very flexible, so that it can bend through between the tips of the teeth and the back. The risk of withdrawal is substantially avoided if the teeth of the comb extend upwardly through the pad by virtue of the fact that this "first", leaf is now the stiffened backing leaf.

In accordance with a preferred embodiment of the invention, the turn-over device can include a hinging mechanism for turning over the backing leaf. the manner in which the backing leaf is turned depends upon the position in which the pad emerges from the binding station at which the comb binding is inserted. When, as is the preferred case, the pad emerges in a sloping position with its spine directed downwardly, and the backing leaf and the cover leaf located lowermost, an embodiment is preferred in which the hinging mechanism for turning over the pad, initially located with the backing leaf lowermost, is turnable into a position in which the penultimate leaf, initially uppermost, is now the lowermost sheet, the hinging mechanism being constructed with a gripper to engage and turn back the backing leaf. Thus, the entire pad is turned upside down and only the backing leaf is held back. For this purpose, the hinging mechanism may be a pivoted plate to which are connected the gripper or grippers which may be in the form of suction cups.

Furthermore, it is preferable for a conveyor to be provided, onto which the turn-over device deposits the pad and which is actuable to convey the pad so that the backing leaf is released from the pivoted plate.

When the pad has assumed such a position, into which it might alternatively be brought in some other manner, it is preferable to use a pusher which transfers the pad, spine foremost, onto a platform whose front edge forms a guide means for the now hanging down backing leaf. The backing leaf, which is hanging down, is thereby folded under the pad, so that the latter now assumes its final position. The platform may be a belt conveyor running in the transfer direction, that is transversely of the direction of the spine of the block, the front roller of the belt conveyor forming the guide means.

The invention also includes a pad having a last or backing leaf which is relatively stiff compared with other leaves of the pad and having a binding comprising a curved-over comb which passes through a row of holes along the spine of the pad to form a comb binding and which has a closure joint which lies between the penultimate leaf of the pad and the underlying relatively stiff last or backing leaf.

Figure 2:
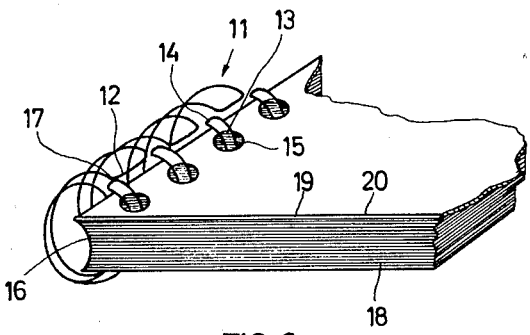
Figure 3:
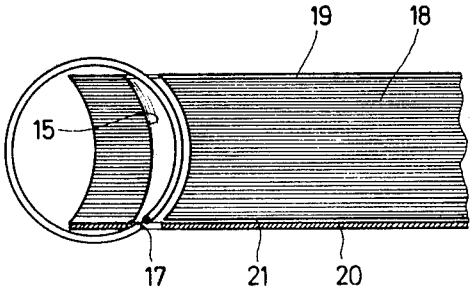
Figure 4:
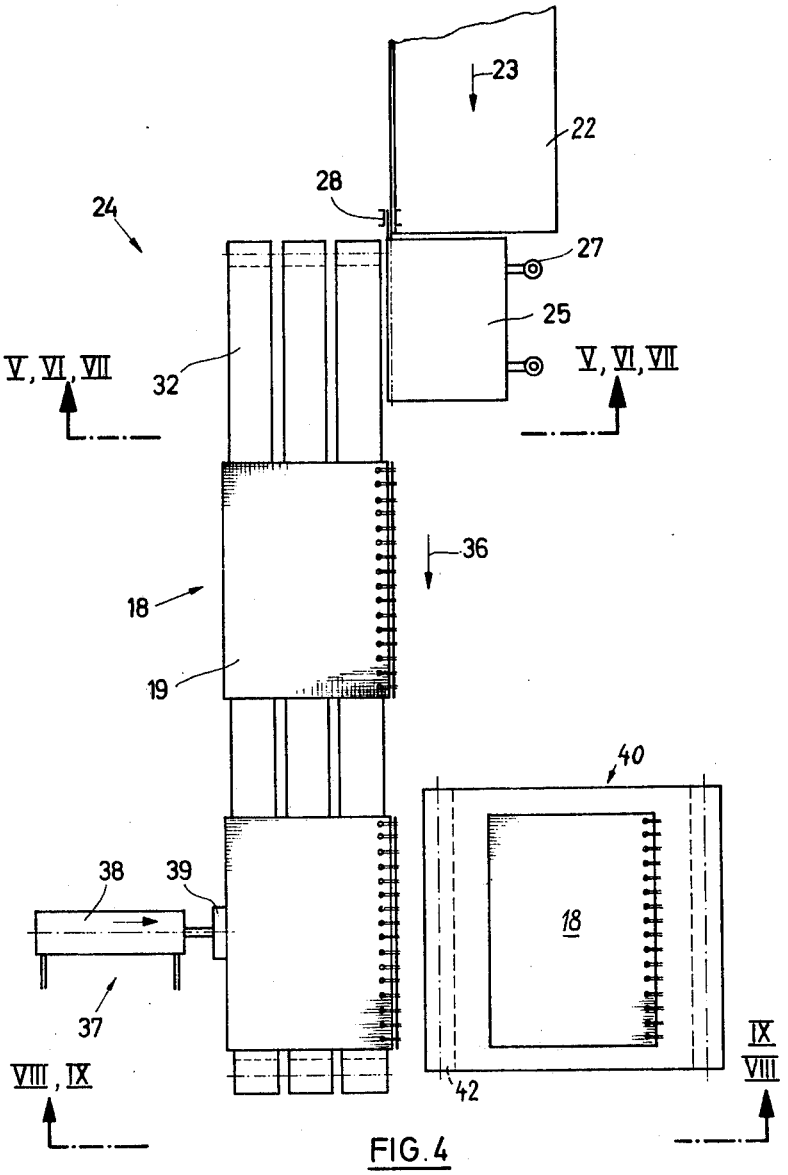
Figure 5:
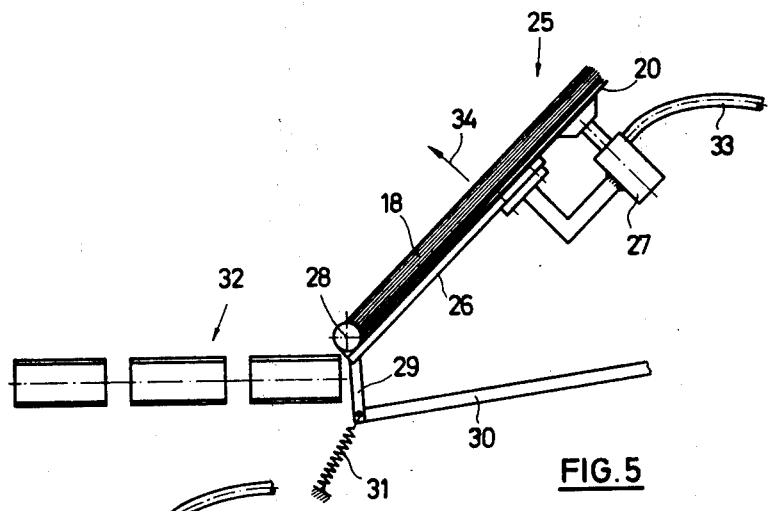
Figure 6:
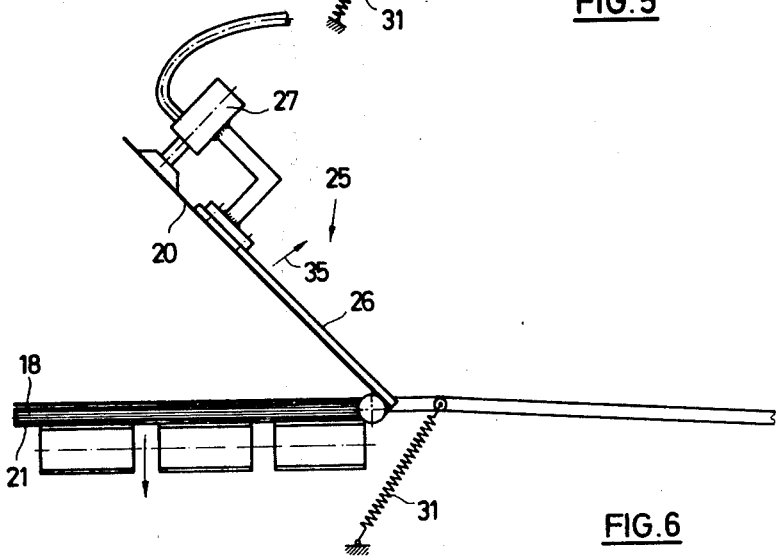

The invention is further described, by way of example, with reference to the accompanying drawings, in which:

FIG. 1 is a developed scheme of a comb for a comb binding usable in connection with the invention, FIG. 2 is a perspective view of a portion of a pad with inserted comb, immediately after the comb has been inserted, FIG. 3 is a cross section, drawn to a larger scale, through the spine of a finished pad, FIG. 4 is a diagrammatic plan view of a binding apparatus in accordance with the invention, and FIGS. 5 to 9 are diagrammatic sections or views taken on the lines V—IX in FIG. 4, showing the function of the apparatus.

The binding to which the invention relates is manufactured preferably with wire combs of the configuration shown in FIGS. 1 and 2. For the purpose of elucidation, the wire comb is shown in developed view in FIG. 1, i.e. it is not curved together to form a cylindrical configuration as is shown in FIG. 2. The comb 11 is bent from a wire such that back portions 12 bridging the distance between the holes in the pad 18 each interconnect two teeth 13 comprising two portions of wire which extend back and forth relatively close to one another and which are interconnected at their tips by means of a bend. As may be seen in FIG. 2, these tongues or teeth 13 are bent together to form a circle such that the ends 14 of the tongues or teeth are substantially in line with the back portions 12, that is they are located in the gaps between the back portions. The teeth 13 extend through the holes 15 extending in a row parallel to the spine 16 of the pad 18. A closed joint 17 is thus formed at the location at which the ends 14 of the teeth and the back portions 12 abut against one another on a parallel to the spine of the pad.

The pad to be manufactured, such as an exercise-book, printed matter such as an instruction manual, or a calender, is shown in its finished form in FIG. 3. The first leaf or page is in the form of a cover sheet 19 which is relatively stiff compared with the normal leaves or pages of the pad 18, while the last leaf or page is substantially thicker and forms a backing leaf 20 made from pasteboard or cardboard. For the reasons already described initially, the closure joint 17 is located between the backing leaf 20 and the last but one leaf 21, which is the last normal leaf pad. Thus, the closure joint is neither unsightly nor inconvenient when turning the pages and, owing to the great thickness of the backing leaf 20, there is no substantial risk that it will slip through between the ends 14 of the teeth and the back portion 12.

FIG. 2 shows the pad 18 in the form in which it is manufactured, that is the backing or last leaf 20 of the pad has been placed over the cover leaf 19. This is not only advantageous owing to the possibility of locating the closure joint at the desired location, but is also advantageous with respect to manufacture, since the two special leaves (cover leaf 19 and last leaf 20) can be fed to the pad 18 together. It will be appreciated that it is also possible to make the cover leaf 19 as thick as the last leaf, although this is usually unnecessary. Of course, manufacture, is not normally effected with the pad oriented as shown in FIG. 2 in which the thicker last leaf is located at the top, rather the pad, after the comb has been closed, assumes a position sloping downwardly towards the spine with the thicker last leaf located underneath, as will be apparent from the following description.

The pad so oriented is advanced in a stepwise manner in the direction of the arrow 23 on a sloping plate 22 as shown in FIG. 4. A turn-over device 24 is illustrated diagrammatically in FIG. 4. The turn-over device includes a hinging mechanism 25 which, as is shown particularly in FIGS. 5 to 7, comprises a plate 26 and grippers 27 which are mounted thereon and which are in the form of known spring biassed suction cups. The plate 26 is mounted so as to be pivotable about a horizontal spindle 28 (FIG. 4) which, advantageously, extends coaxially of the comb 11. The plate 26 is pivotable in an anti-clockwise direction against the force of a spring 31 from its position illustrated in FIG. 5, in which it is aligned with the plate 22, by means of a lever arm 29 mounted on the plate and a pull rod 30. A conveyor 32, comprising belts extending parallel to one another, extends parallel and adjacent to the bottom edge of the plate 26, i.e. the spindle 28 thereof.

The first portion of the apparatus which has so far been described functions in the following manner:

The pad, advanced on the plate 22 in the direction of the arrow 23 by means of a device (not illustrated) runs onto the plate 26. The suction cup of the gripper 27 is advanced against the spring bias by the application of vacuum by way of a connection hose 33 and, under the action of suction, grips the thicker last leaf 20 which is exposed at the upper region of the pad. Simultaneously therewith, or subsequently, the plate 26 of the hinging mechanism 25 is pivoted about the spindle 28 by moving the pull rod 30 to the right, as viewed in FIG. 5, by means of a control device (not illustrated). The hinging mechanism 25 is thereby pivoted in an anti-clockwise direction (in the direction of the arrow 34 in FIG. 5,) together with the pad 18. When the hinging mechanism 25 pivots beyond the perpendicular, the pad, with the exception of the last leaf 20 gripped by the gripper 27, drops onto the conveyor 32. The pad 18 then rests on the last normal leaf 21 of the pad.

Figure 7:
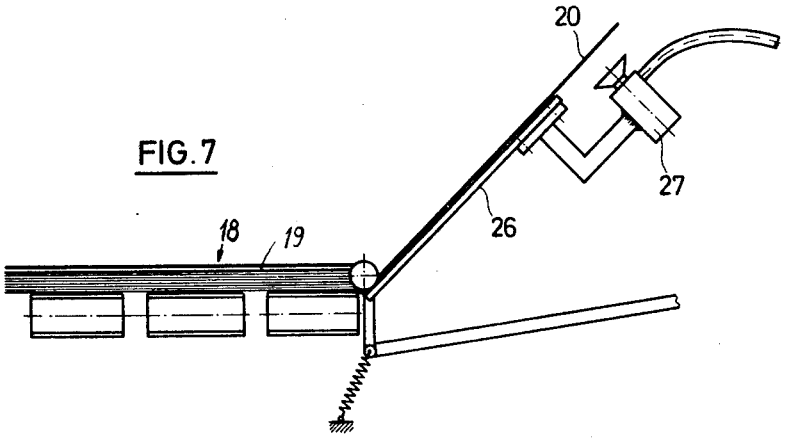

The hinging mechanism 25 is then pivoted back in a clockwise direction (arrow 35 in FIG. 6) under the action of the spring 31 until the plate 26 again assumes its position pivoted towards the right (FIG. 7). By switching off the vacuum, the suction cup of the gripper 27 releases the last leaf 20 which alone is still resting against the plate 26, and is retracted into its withdrawn position by the spring bias.

Figure 8:
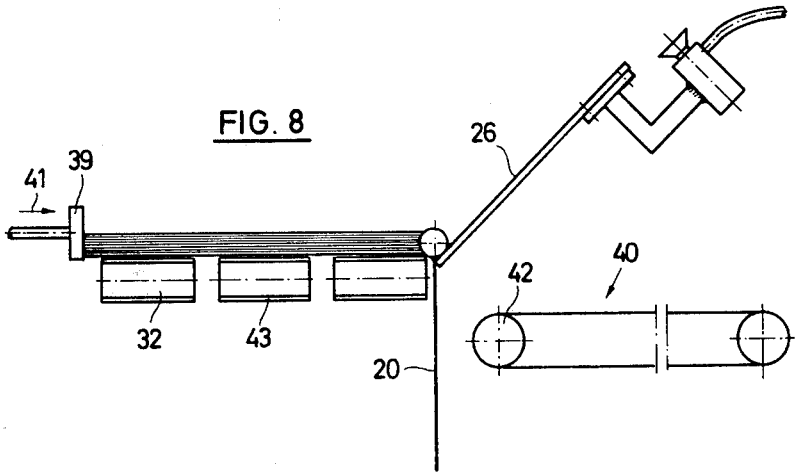

The conveyor 32 is then advanced by one step (in the direction of the arrow 36 in FIG. 4) within the extent of the working cycle, so that the last leaf 20 slides off the plate 26 and drops freely into a downwardly hanging position as is shown in FIG. 8.

After one or several working cycles, the pad 18, with the cover leaf 19 located uppermost and the last leaf 20 hanging down, enters the region of a pusher 37 which can comprise, for example, a pneumatic cylinder 38 and a plunger 39 secured to its piston rod. The plunger engages the edge of the pad remote from the spine and can thus push the pad, with its spine or comb leading, from the conveyor 32. The pad is thereby pushed onto a platform 40 which, in the illustrated embodiment, comprises a belt conveyor which is located somewhat lower than the belt conveyor forming the conveyor 32 and which operates in a horizontal direction at 90° to the conveyor 32, i.e. in the same direction as the pusher.

Figure 9:
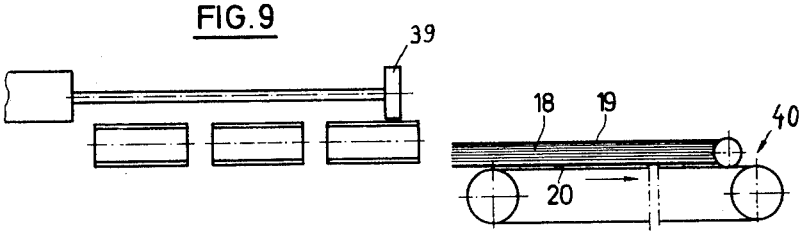

It will be seen from FIGS. 8 and 9 that, when the pad is pushed in the direction of the arrow 41, the last leaf 20 comes into abutment against the front roller 42 of the belt conveyor forming the platform 40, which roller forms a guide for the last leaf and swings the latter upwardly until it is located below the pad when the entire pad has been transferred to the platform 40. Thus, the pad 18 has reached its orientation illustrated in FIG. 3 and is in its finished state.

It will be seen that, in the illustrated embodiment, the upper surface of the platform 40 for supporting the pad must be somewhat lower than the returning run 43 of the conveyor 32, thus preventing the last leaf 20 from being clamped when it is swung upwardly in a clockwise direction. Alternatively, however, it is also possible to guide the returning run substantially lower, so that it lies outside the pivotal range of the last leaf 20.

A large number of modifications of the illustrated embodiment are possible within the scope of the invention. Thus, the entire pad assembly operation can be effected in a single stage. However, in the preferred embodiment illustrated, satisfactory assembly is ensured with maximum protection of the pad.

We claim:

1. An apparatus for binding pads, such as exercise books, calendars and the like, having a relatively stiff backing leaf, the apparatus being of the kind which inserts a comb binding through a row of holes along the spine of the pad and curves the teeth of the comb over to form a closure joint along the spine, the improvement comprising turn-over means for turning over the relatively stiff backing leaf from a position overlying the front leaf of the pad in which the pad was assembled before the insertion of the comb to a position underlying the pad with the closure joint located between the penultimate leaf of the pad and the immediately underlying backing leaf, said turn-over means comprising: a hinging mechanism for swinging over said backing leaf, said hinging mechanism being pivotable from a first position, in which the backing leaf of the pad is lowermost and the penultimate leaf is uppermost, to a second position in which the pad is turned over, so that the penultimate leaf is lowermost; and, gripping means for gripping the last leaf to turn the latter back when said hinging mechanism is pivoted back to said first position.

2. The improvement according to claim 1, in which said hinging mechanism comprises a pivotable plate to which said gripping means are attached.

3. The improvement according to claim 1, in which said gripping means comprising at least one suction cup.

4. An apparatus for binding pads, such as exercise books, calendars and the like, having a relatively stiff backing leaf, the apparatus being of the kind which inserts a comb binding through a row of holes along the spine of the pad and curves the teeth of the comb over to form a closure joint along the spine, the improvement comprising:

turn-over means for turning over the relatively stiff backing leaf from a position overlying the front leaf of the pad in which the pas was assembled before the insertion of the comb to a position underlying the pad with the closure joint located between the penultimate leaf of the pad and the immediately underlying backing leaf, said turn-over means having a hinging mechanism for swinging over said backing leaf; and, conveyor means arranged to receive the turned-over pad deposited by said hinging mechanism and operable to convey the deposited pad, first leaf uppermost, away from said hinging mechanism to release the turned-back backing leaf therefrom and enable the latter to swing down.

5. The improvement according to claim 4, further comprising platform means and pusher means arranged relatively to said conveyor means to transfer the pad, first leaf uppermost and spine foremost, from said conveyor means to said platform means, the latter having a front edge engaged by the hanging backing leaf to turn the latter under the pad upon such transfer.

6. The improvement according to claim 5, in which said platform means comprises a belt conveyor running in the direction of said transfer.

* * * * *